US010729929B2

(12) United States Patent
Casanova

(10) Patent No.: US 10,729,929 B2
(45) Date of Patent: Aug. 4, 2020

(54) TRAINING AID FOR OLYMPIC WEIGHTLIFTING

(71) Applicant: Gabriel E. Casanova, Miami, FL (US)

(72) Inventor: Gabriel E. Casanova, Miami, FL (US)

( * ) Notice: Subject to any disclaimer, the term of this patent is extended or adjusted under 35 U.S.C. 154(b) by 53 days.

(21) Appl. No.: 16/142,976

(22) Filed: Sep. 26, 2018

(65) Prior Publication Data

US 2019/0091508 A1 Mar. 28, 2019

Related U.S. Application Data

(60) Provisional application No. 62/563,141, filed on Sep. 26, 2017.

(51) Int. Cl.
*A63B 21/075* (2006.01)
*A63B 24/00* (2006.01)
(Continued)

(52) U.S. Cl.
CPC ..... *A63B 21/075* (2013.01); *A63B 15/00* (2013.01); *A63B 21/0724* (2013.01);
(Continued)

(58) Field of Classification Search
CPC ... A63B 15/00; A63B 15/005; A63B 21/0004; A63B 21/00058; A63B 21/00061; A63B 21/00065; A63B 21/072; A63B 21/0724; A63B 21/0728; A63B 21/075; A63B 21/22; A63B 21/4023; A63B 21/4027; A63B 21/4033; A63B 21/4035; A63B 21/4041; A63B 21/4043; A63B 21/4045; A63B 21/4049; A63B 23/035; A63B 23/03516; A63B 23/03575; A63B 23/04; A63B 23/0405; A63B 23/0482; A63B 2023/0411; A63B 24/0062; A63B 2024/0065; A63B 2024/0071; A63B 71/0619; A63B 71/0622; A63B 2071/0625; A63B 2071/0627; A63B 2071/0633; A63B 2071/0655; A63B 2208/0204; A63B 2208/0223; A63B 2209/00; A63B 2244/09
See application file for complete search history.

(56) References Cited

U.S. PATENT DOCUMENTS 2,223,574 A * 12/1940 Paves ..... A63B 15/00 482/108
3,781,007 A * 12/1973 Baker ..... A63B 21/0602 482/108
(Continued)

*Primary Examiner* — Gary D Urbiel Goldner
(74) *Attorney, Agent, or Firm* — Mark Terry

(57) ABSTRACT

A training aid for weighlifting includes a shaft, a first grip area extending from a left end of the shaft towards a midpoint of the shaft, a second grip area extending from a right end of the shaft towards the midpoint of the shaft, wherein the first and second grip areas include a non-slip material, one or more rings located at the midpoint of the shaft, and wherein the one or more rings generate an audible sound when rotated about the shaft, stoppers affixed to the shaft between the grip areas and the one or more rings, wherein the stoppers are configured to prevent the one or more rings from moving towards the grip areas, and wherein when a user lifts the training aid and the one or more rings graze the user, the one or more rings rotate about the shaft and generate the audible sound.

20 Claims, 3 Drawing Sheets

(51) Int. Cl.
*A63B 71/06* (2006.01)
*A63B 15/00* (2006.01)
*A63B 21/072* (2006.01)

(52) U.S. Cl.
CPC ..... *A63B 24/0062* (2013.01); *A63B 71/0622* (2013.01); *A63B 2071/0625* (2013.01); *A63B 2209/00* (2013.01); *A63B 2244/09* (2013.01)

(56) References Cited

U.S. PATENT DOCUMENTS

| | | | | | |
|---|---|---|---|---|---|
| 4,664,373 | A * | 5/1987 | Hait | A63B 21/0603 | 482/109 |
| 4,828,256 | A * | 5/1989 | Lee | A63B 21/0724 | 482/106 |
| 5,125,649 | A * | 6/1992 | Fuller | A63B 21/0004 | 482/106 |
| 5,152,731 | A * | 10/1992 | Troutman | A63B 21/0724 | 482/106 |
| 5,209,481 | A * | 5/1993 | Deback | A63B 21/0004 | 473/220 |
| 5,536,227 | A * | 7/1996 | Polchek | A63B 21/0728 | 482/106 |
| 5,634,856 | A * | 6/1997 | Rainey | A63B 60/04 | 473/234 |
| 2002/0183129 | A1* | 12/2002 | Koncelik, Jr. | A63B 15/00 | 473/234 |
| 2015/0038302 | A1* | 2/2015 | O'Brien | A63B 21/0724 | 482/107 |
| 2015/0367185 | A1* | 12/2015 | Vrska | A63B 53/02 | 473/305 |
| 2017/0266478 | A1* | 9/2017 | Black | A63B 21/0724 | |
| 2018/0236299 | A1* | 8/2018 | Warriner | A63B 21/4035 | |

* cited by examiner

TRAINING AID FOR OLYMPIC WEIGHTLIFTING

CROSS-REFERENCE TO RELATED APPLICATIONS

This application claims the benefit of U.S. Provisional Application No. 62/563,141 entitled "Training Aid for Olympic Weightlifting" filed on Sep. 26, 2017.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The claimed subject matter relates to the field of sports training, and more particularly to training aids and accessories for Olympic weightlifting.

BACKGROUND

The sport of weightlifting has one primary objective, which is to lift the maximum amount of weight overhead. Olympic weightlifting, otherwise known as 'weightlifting' or 'Olympic-style weightlifting' is a registered sport which incorporates the use of two independent lifts which require the athlete to lift a loaded barbell from the floor to an overhead position in an explosive manner. The two competition lifts are the snatch, followed by the clean and jerk. In a competition, each athlete will be granted a total of three attempts in each lift, and the highest successful lift in each event will comprise the athlete's total.

The snatch is a single movement where the athlete holds the bar in a wide grip or snatch grip (wider than shoulder width), lifts the weight off the ground overhead in one movement, then stands upright holding the bar overhead. The athlete may recover in his or her own time, either from a split or a squat position, and finish with the feet on the same line, parallel to the plane of the trunk and the barbell.

The clean and jerk is a two-part movement. In the first part of the lift, the clean or power clean, the athlete grips the bar approximately shoulder width using a power clean grip (more narrow than the wide grip used for the snatch grip above), pulls it as high as possible in one continuous motion, and then drops under the weight in a squat position while receiving the bar on the shoulders and upper chest. In the second part of the lift, the jerk, the athlete dips and drives the weight up as high as possible, extending the knees and hips and rising up on the toes. The feet are quickly split apart with one forward and one backward while the body drops under the weight which is caught in a split position. To complete the lift, the athlete will recover by bringing the feet in line and shoulder width apart.

One of the keys to mastering the snatch, and the clean and jerk is the power position. The power position is the point during the snatch or clean where the athlete's torso is erect, knees slightly bent, feet flat and the bar grazes or lightly touches the top of the hip or thighs (see FIG. 6). A common problem with beginners learning to perform the snatch, and the clean and jerk is that the athlete does not bring the bar close enough to his or her body when in the power position. The power position is critical because it allows the athlete to maintain the bar close to the body and control his or her center of gravity. Failure to utilize the correct power position form will undoubtedly cause horizontal displacement of the bar, a decrease in the speed of the bar, and a reduction in power output. Therefore, if an athlete wants to maximize his or her potential and be as competitive as he or she can be, good technique is essential.

Current best practices indicate the greatest benefits are derived from learning proper weightlifting technique at the outset of training. However, there are no currently available training aids to learn how to properly place the bar and body in the power position to maximize the amount of weight an athlete can lift overhead with a given level of strength and power. Consequently, a need exists to overcome the problems with the prior art as discussed above, and particularly for improved and innovative training aids for athletes engaged in Olympic weightlifting.

SUMMARY

A training aid for weightlifting is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

According to an embodiment, a training aid for weightlifting is disclosed. The training aid includes a shaft having a length of about 6 feet to about 7.5 feet and having an outer diameter from about 0.8 inch to about 1.3 inches, a first grip area extending from a left end of the shaft towards a midpoint of the shaft, wherein the first grip area includes a non-slip material, a second grip area extending from a right end of the shaft towards the midpoint of the shaft, wherein the second grip area includes the non-slip material, one or more rings located at the midpoint of the shaft, wherein the rings have inner diameters larger than the outer diameter of the shaft, and wherein the rings generate an audible sound when rotated about the shaft, a first stopper affixed to the shaft between the first grip area and the one or more rings, wherein the first stopper is configured to prevent the one or more rings from moving towards the first grip area, a second stopper affixed to the shaft between the second grip area and the one or more rings, wherein the second stopper is configured to prevent the one or more rings from moving towards the second grip area, and wherein when a user lifts the training aid and the one or more rings graze the user, the one or more rings rotate about the shaft and generate an audible sound.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the claimed subject matter and together with the description, serve to explain the principles of the disclosed embodiments. The embodiments illustrated herein are presently preferred, it being understood, however, that the claimed subject matter is not limited to the precise arrangements and instrumentalities shown, wherein:

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the claimed subject matter as oriented in each figure. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The disclosed embodiments solve the problems with the prior art by providing an innovative and ingenious training aid for Olympic weightlifting. The claimed subject matter can be used by beginners and other athletes learning to perform the snatch, and the clean and jerk, by ensuring that the athlete brings the bar close enough to his body when in the power position. Repeating a movement over and over has little value unless an athlete understands the result of the effort. The disclosed embodiments improve over the prior art by providing the athlete with feedback that is conveyed in a measurable way. When the bar is brought upwards past the knees, the athlete will know whether the bar grazes or touches the front of the athlete's hip or thigh because the claimed device will make an audible noise. Practice will develop a far more flowing movement with the athlete being able to make more and more minor adjustments as the skill becomes more autonomous. This will ensure that the bar is close enough to the athlete's body when in the power position. The claimed subject matter benefits from the device by ensuring that the athlete gains the greatest efficiency and can lift an optimal amount of weight.

Referring now to the figures generally and to certain figures more specifically, there is shown and described a training aid for weightlifting according to embodiment of the claimed subject matter.

Figure 1:
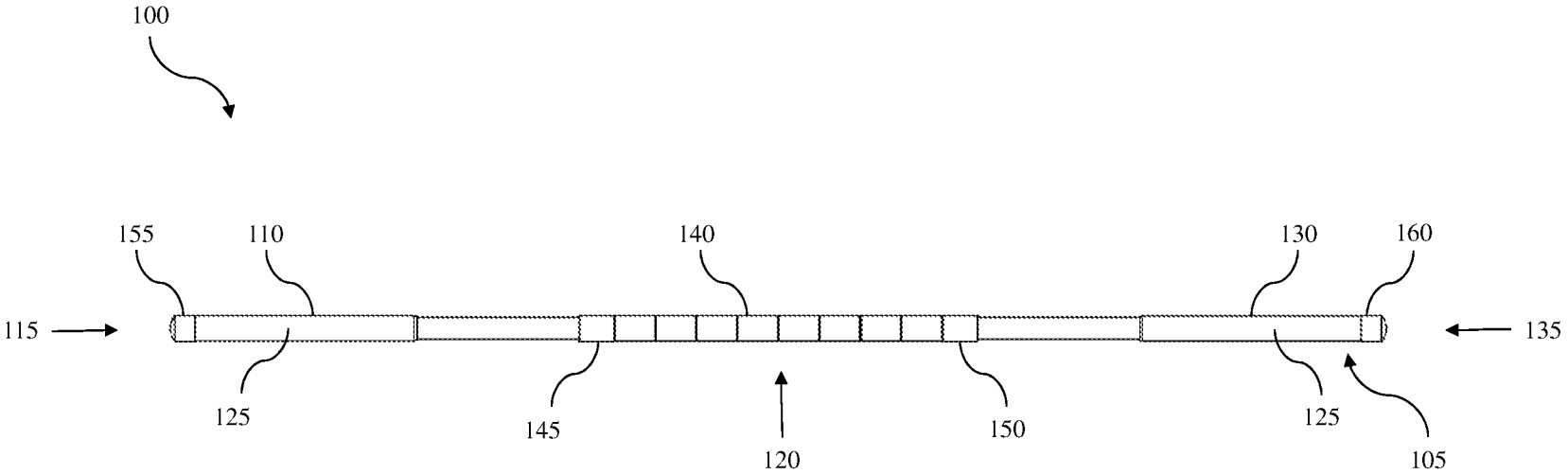
FIG. 1 is a front view of the training aid for weightlifting, according to an example embodiment.

FIG. 1 is an illustration of a front view of the training aid 100 for weightlifting, according to one embodiment. The training aid includes an elongated shaft 105 that is generally cylindrical in cross-sectional shape and has two ends. The length of the shaft can range from approximately 6 feet (1.8 meters) to approximately 7.5 feet (2.2 meters). In another embodiment, the shaft can have any length configured for holding by a user in the snatch grip (i.e., using a wide grip as described above), wherein the user holds the bar or shaft with this hands spaced at about 22 inches or spaced from about 20 inches to about 24 inches. In another embodiment, the shaft can have any length configured for holding by a user in the power clean grip (i.e., using a shoulder width grip as described above), wherein the user holds the bar or shaft with this hands spaced at about 44 inches or spaced from about 42 inches to about 46 inches.

The outer diameter of the shaft can range from about 0.8 inch (2 centimeters) to about 2 inches (5 centimeters). In one embodiment, the outer diameter of the shaft may be 28 mm (1.1 inch). The foregoing measurements, together with other measurements, shapes and dimensions that will be discussed, and are to be considered illustrative and not limiting. The shaft may be formed from a single piece or from several individual pieces joined or coupled together. The shaft may be made of a high-strength, essentially rigid material, such as metal, stainless steel, iron, chromoly, aluminum, magnesium, or titanium, but may be constructed of any type of material, including plastics, composites, and other man made materials that are within the scope of the claimed subject matter. Additionally, the shaft may be completely exposed, or covered with a layer of rubber, leather, or plastic. Also, the shaft may be a hollow cylinder, such as a tube, or a solid item. It is also understood that it is within the spirit and scope of the claimed subject matter that the shaft may also comprise ornamental features, textures, finishes and designs.

The training aid also includes a first grip area 110 extending from the left end 115 of the shaft towards the midpoint 120 of the shaft, and a second grip area 130 extending from the right end 135 of the shaft towards the midpoint of the shaft. A grip area is an area of the shaft 105 that is configured for gripping by the user's hand—i.e., an area for gripping the shaft. The first and second grip areas may be separated by a distance configured for holding by a user in the snatch grip (i.e., using a wide grip as described above) or in the power clean grip (i.e., using a shoulder width grip as described above). Both the first and second grip areas may be covered with a circumferential non-slip material 125. Non-slip materials may include grip tape, rubber, leather, vinyl, or combinations and equivalents thereof. It is also understood that it is within the spirit and scope of the claimed subject matter that the non-slip material may also comprise ornamental features, textures, finishes and designs. Both the first and second grip areas may alternatively be covered with a knurled crosshatch pattern to help lifters maintain a solid grip. Knurling is a manufacturing process whereby a pattern of straight, angled or crossed lines is etched or rolled into the material of the shaft 105. Knurling allows hands or fingers to get a better grip on the shaft than would be provided by the originally smooth surface. The definition of non-slip material includes knurling on the shaft 105, as described above.

The training aid also includes one or more rings 140 located at the midpoint of the shaft. The rings have an inner diameter that are larger than the outer diameter of the shaft to generate an audible sound (see FIG. 2) when rotated about the shaft. It should be appreciated that the shape of the rings is not limited to the embodiments shown in the figures, and that other shapes may also be used. The rings may be composed from thin sheets of metal and may extend from about 12 inches (30.4 centimeters) to about 18 inches (45.7 centimeters) along the midpoint of the shaft. The rings may comprise other materials such as carbon steel, stainless steel, aluminum, titanium, other metals or alloys, composites, fiberglass, ceramics, polymeric materials such as polycarbonates, such as acrylonitrile butadiene styrene (ABS plastic), Lexan™, and Makrolon™ It is also understood, that it is within the spirit and scope of the claimed subject matter that the rings may also comprise ornamental features, textures, finishes and designs.

Figure 3:
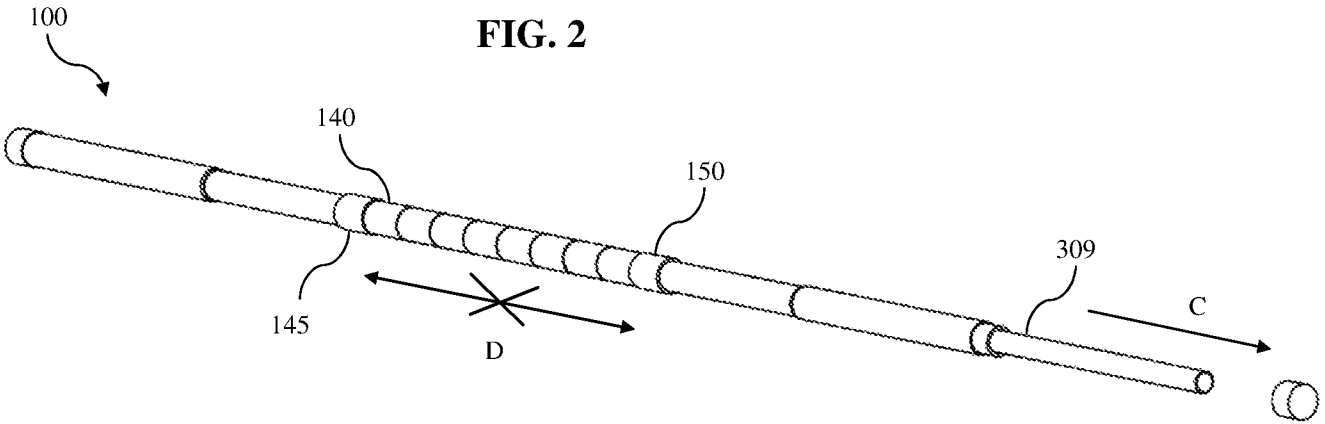
FIG. 3 is a perspective view of the training aid for weightlifting, wherein the end element is detached from one end of the shaft, according to an example embodiment.

The training aid also includes a first stopper 145 affixed to the shaft between the first grip area and one or more rings, wherein the first stopper is configured to prevent one or more rings from moving towards the first grip area (see FIG. 3), as well as a second stopper 150 affixed to the shaft between the second grip area and one or more rings, wherein the second stopper is configured to prevent one or more rings from moving towards the second grip area (see FIG. 3). The first and second stoppers may further comprise plastic rings affixed to the shaft, wherein said plastic rings have outer diameters larger than the inner diameter of one or more rings. The stoppers may comprise other materials such as carbon steel, stainless steel, aluminum, titanium, other metals or alloys, composites, fiberglass, ceramics, polymeric materials such as polycarbonates, such as acrylonitrile butadiene styrene (ABS plastic), Lexan™, and Makrolon™. It is also understood, that it is within the spirit and scope of the claimed subject matter that the stoppers may also comprise ornamental features, textures, finishes and designs.

In another embodiment, the stoppers may simply be protrusions on the shaft 105 that prevent the one or more rings from moving towards the first and second grip areas.

The training aid also includes an end element 155 affixed to the left end of the shaft, and an end element 160 affixed to the right end of the shaft. The end elements are affixed to the ends of the shaft using a friction fit. It is understood that the end elements may be held in place using any other suitable method known in the art, including adhesives, lips, snaps, set screws, screws, and clips. The end elements may be formed from the same material as the shaft, or they may be formed from other materials that are within the scope claimed subject matter. In one embodiment, the end elements may be caps that fit on the ends of the shaft 105. In another embodiment, the end elements may simply be protrusions on the ends of the shaft 105 that terminate the first and second grip areas.

Figure 2:
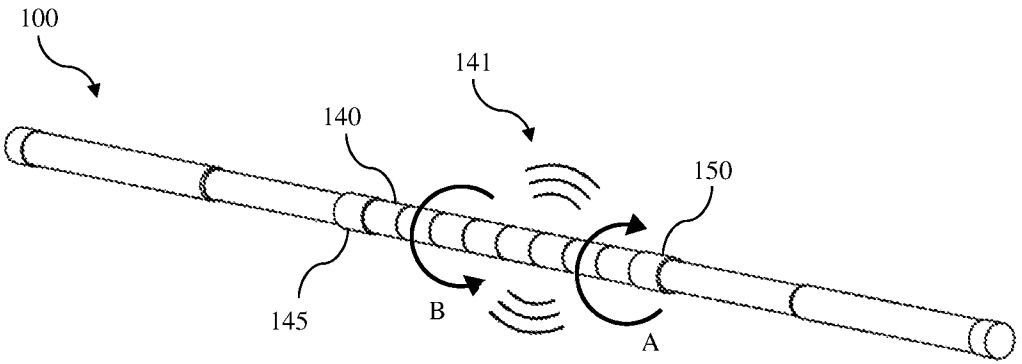
FIG. 2 is a perspective view of the training aid for weightlifting, according to an example embodiment.

FIG. 2 is a perspective view of a training aid for weightlifting, according to an example embodiment. As previously discussed, a common problem with beginners learning to perform the snatch, and the clean and jerk is that the athlete does not bring the bar close enough to his or her body when in the power position. When in the power position, the bar must make contact with the athlete at different points on the body. In the snatch, the bar should make contact with the hip, whereas in the power clean, the bar should make contact with the thigh. The training aid is configured to give an athlete instant feedback and create the proper muscle memory to ensure that the training aid is close enough to the body during the power position. In both lifts, the athlete will know if the training aid grazes or touches the front of the athlete's hip or thigh because the claimed device will make an audible noise 141. The audible noise is created from one or more rings rotating in both clockwise (circular arrow line A) and counter-clockwise (circular arrow line B) directions about the shaft after coming into contact with the athlete's hip or thigh (see FIG. 6) during the power position. As illustrated in FIG. 3, the training aid is configured such that there is effectively no horizontal movement (in the direction of double arrow line D) between the rings and both, the first stopper affixed to the shaft between the first grip area, and the second stopper affixed to the shaft between the second grip area.

FIG. 3 is a perspective view of the training aid for weightlifting, wherein the end element is detached from one end of the shaft, according to an example embodiment. FIG. 3 is a perspective view of the training aid for weightlifting, wherein the end element is detached from one end of the shaft, according to an example embodiment. The end element affixed to the left end of the shaft, and the end element affixed to the right end of the shaft may be removed (in the direction of arrow line D) and replaced with custom end elements having many different durometers, colors, wall thickness, and lengths to improve the overall aesthetic appearance of the training aid. Additionally, the shape of the end elements are not limited to the shapes depicted in the figures, such shapes may take other forms, and such variations are within the spirit and scope of the claimed subject matter.

FIG. 3 also shows that the shaft 105 may be hollow and may include a weighted shaft 309 that is inserted into the shaft 105. The weighted shaft 309 may be used to add weight to the device 100, so as to emulate the weight of a bar used in competition or training. The weighted shaft 309 may be a solid object or may be hollow. In one embodiment, a series of weighted shafts, each having a different weight, may be provided to the user, along with device 100, so as to provide the user with a variety of weights to choose from, when emulating the weight of a bar used in competition or training (since different weight categories use bars of differing weight in competition and training). In one embodiment, a series of weighted shafts are provided along with shaft 105, wherein the weighted shafts increase the weight of the shaft 105 to either 44 pounds or 33 pounds, when inserted into the shaft 105.

Figure 6:
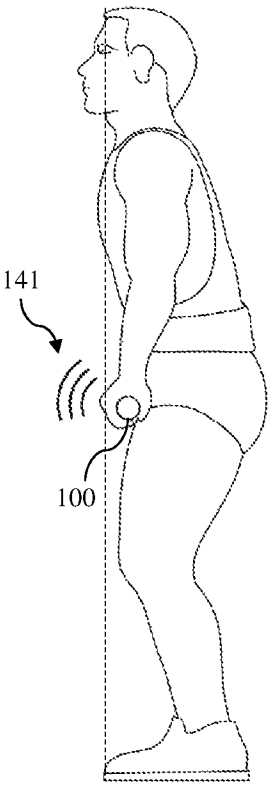
FIG. 6 is a side view of an athlete holding the training aid for weightlifting into the thighs in the power position, according to an example embodiment.
Figure 5:
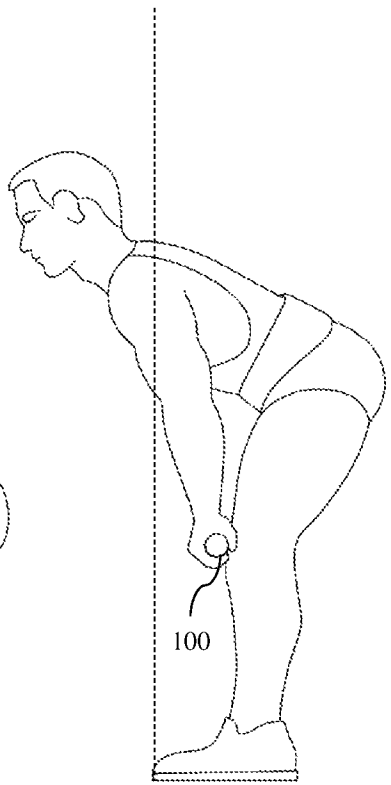
FIG. 5 is a side view of an athlete holding the training aid for weightlifting just above the knees in a middle position, according to an example embodiment.
Figure 4:
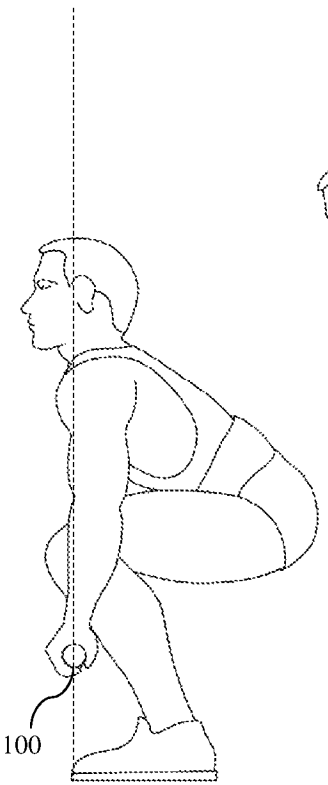
FIG. 4 is a side view of an athlete holding the training aid for weightlifting close to the shins in the bottom position, according to an example embodiment.

FIGS. 4-6, are illustrations of an athlete utilizing the training aid for weightlifting, according to one embodiment. FIG. 4 is a side view of an athlete holding the training aid for weightlifting close to the shins, in a bottom position, according to an example embodiment. In the starting bottom position, the same motions and principles employed in the snatch apply to the power clean. The athlete prepares to lift the training aid from the platform using a hook grip. The hook grip is secured by hooking the thumb around the training aid, then wrapping the index and middle finger, or at least the forefinger, over the thumb, the remaining fingers wrapping around the training aid. Feet are positioned approximately at hip width and the training aid is placed directly above the base of the toes; the toes are generally turned out somewhat, so that they are moderately wider than the heels. Shoulders are directly above the training aid or slightly forward of it and the shoulders are also above the hips, while the hips are lightly to moderately above the knees. Shins are leaning forward and are very close to the training aid or lightly brushing it, and the athlete's balance is toward the middle of the feet or slightly forward of the middle. Arms are straight and relaxed with the crooks, the insides, of the elbows facing the torso.

FIG. 5 is a side view of an athlete holding the training aid for weightlifting just above the knees, in a middle position, according to an example embodiment. When lifting the training aid from the floor to knee level, it is generally lifted smoothly from the floor with the shoulders and hips rising together, the training aid being lifted to knee height solely by the legs. Shins moving to a completely upright or vertical position, as the legs alone raise the training aid from floor to knee level or just above by partially extending the legs without straightening the torso with the balance shifting toward the middle of the foot or beginning of the heel; and the feet remain flat on the floor. The training aid travelling slightly backward toward the athlete so that it is over the instep as it reaches the height of the knees, causing the shoulders, which have travelled upward at the same rate as the hips and sometimes forward as well, to now be positioned in front of the training aid more so than at the start. Arms remain straight and the arm muscles relaxed.

FIG. 6 is a side view of an athlete holding the training aid for weightlifting into the thighs in the poser position, according to an example embodiment. As, or a little after the training aid passes the knees, the athlete's goal is to achieve the all-important power position referred to earlier. In the power position, the weight distribution on the foot remains over the ankle and the extension starts proximally and moves distally. In other words, the athlete initiates the extension by driving the hips up into the bar while driving the quads down into the ground. In slow motion, the knees will complete their extension before the hips due to the greater angle and size of the lever but the hips always initiate the movement. During the power position, the training aid should make contact with the athlete at different points on the body. In the snatch, the training aid should make contact with the hip, whereas in the clean, the training aid should make contact with the thigh. In both lifts, the athlete will know whether the bar grazes or touches the front of the athlete's hip or thigh because the claimed device will make an audible noise to ensure that the training aid is close enough to the body during the power position.

Although specific embodiments have been disclosed, those having ordinary skill in the art will understand that changes can be made to the specific embodiments without departing from the spirit and scope of the claimed subject matter. The scope of the claimed subject matter is not to be restricted, therefore, to the specific embodiments. Furthermore, it is intended that the appended claims cover any and all such applications, modifications, and embodiments within the scope of the claimed subject matter.

I claim:

1. A training aid for weightlifting, comprising:

a shaft having a length of about 6 feet to about 7.5 feet and having an outer diameter from about 0.8 inches to about 1.3 inches;

a first grip area extending from a left end of the shaft towards a midpoint of the shaft, wherein the first grip area includes a non-slip material;

a second grip area extending from a right end of the shaft towards the midpoint of the shaft, wherein the second grip area includes the non-slip material;

one or more rings located at the midpoint of the shaft, wherein the one or more rings respectively have inner diameters larger than the outer diameter of the shaft, and wherein the one or more rings generate an audible sound when rotated about the shaft;

a first stopper affixed to the shaft between the first grip area and the one or more rings, wherein the first stopper is configured to prevent the one or more rings from moving towards the first grip area;

a second stopper affixed to the shaft between the second grip area and the one or more rings, wherein the second stopper is configured to prevent the one or more rings from moving towards the second grip area; and wherein the training aid is configured such that when a user lifts the training aid and the one or more rings graze the user, the one or more rings rotate about the shaft and generate the audible sound.

2. The training aid of claim 1, wherein the shaft is made of metal.

3. The training aid of claim 2, wherein the non-slip material further comprises a grip tape that is wrapped about the first grip area and the second grip area.

4. The training aid of claim 3, wherein the one or more rings are composed of thin sheets of metal.

5. The training aid of claim 4, wherein the one or more rings extend from about 12 inches to about 18 inches along the shaft.

6. The training aid of claim 5, wherein the first and second stoppers further comprise plastic rings affixed to the shaft, wherein said plastic rings have outer diameters larger than the respective inner diameters of the one or more rings.

7. The training aid of claim 1, wherein the shaft is hollow and further comprising a weighted shaft that is inserted into the shaft to increase weight of the training aid.

8. A training aid for weightlifting, comprising:

a shaft having a length configured for holding by a user in a power clean grip or a snatch grip;

a first grip area extending from a left end of the shaft towards a midpoint of the shaft, wherein the first grip area includes a non-slip material;

a second grip area extending from a right end of the shaft towards the midpoint of the shaft, wherein the second grip area includes the non-slip material;

one or more rings located at the midpoint of the shaft, wherein the one or more rings respectively have inner diameters larger than an outer diameter of the shaft, and wherein the one or more rings generate an audible sound when rotated about the shaft;

a first stopper affixed to the shaft between the first grip area and the one or more rings, wherein the first stopper is configured to prevent the one or more rings from moving towards the first grip area;

a second stopper affixed to the shaft between the second grip area and the one or more rings, wherein the second stopper is configured to prevent the one or more rings from moving towards the second grip area; and wherein the training aid is configured such that when the user lifts the training aid and the one or more rings graze the user, the one or more rings rotate about the shaft and generate the audible sound.

9. The training aid of claim 8, wherein the shaft is made of metal.

10. The training aid of claim 9, wherein the non-slip material further comprises a grip tape that is wrapped about the first grip area and the second grip area.

11. The training aid of claim 10, wherein the one or more rings are composed of thin sheets of metal.

12. The training aid of claim 11, wherein the one or more rings extend from about 12 inches to about 18 inches along the shaft.

13. The training aid of claim 12, wherein the first and second stopper further comprise plastic rings affixed to the shaft, wherein said plastic rings have outer diameters larger than the inner diameter of the one or more rings.

14. The training aid of claim 8, wherein the shaft is hollow and further comprising a weighted shaft that is inserted into the shaft to increase weight of the training aid.

15. A training aid for weightlifting, comprising:

a shaft having a length configured for holding by a user in a power clean grip or a snatch grip;

a first grip area extending from a left end of the shaft towards a midpoint of the shaft, wherein the first grip area includes a non-slip material, wherein the first grip area is located at a position on the shaft configured for holding by the user in the power clean grip or the snatch grip;

a second grip area extending from a right end of the shaft towards the midpoint of the shaft, wherein the second grip area includes the non-slip material, wherein the second grip area is located at a position on the shaft configured for holding by the user in the power clean grip or the snatch grip;

one or more rings located at the midpoint of the shaft, wherein the one or more rings respectively have inner diameters larger than an outer diameter of the shaft, and wherein the one or more rings generate an audible sound when rotated about the shaft;

a first stopper affixed to the shaft between the first grip area and the one or more rings, wherein the first stopper is configured to prevent the one or more rings from moving towards the first grip area;

a second stopper affixed to the shaft between the second grip area and the one or more rings, wherein the second stopper is configured to prevent the one or more rings from moving towards the second grip area; and wherein the training aid is configured such that when the user lifts the trainig aid and the one or more rrings graze the user, the one or more rings rotate about the shaft and generate the audible sound.

16. The training aid of claim 15, wherein the shaft is made of metal.

17. The training aid of claim 16, wherein the non-slip material further comprises a grip tape that is wrapped about the first grip area and the second grip area.

18. The training aid of claim 17, wherein the one or more rings are composed of thin sheets of metal.

19. The training aid of claim 18, wherein the one or more rings extend from about 12 inches to about 18 inches along the shaft.

20. The training aid of claim 15, wherein the shaft is hollow and further comprising a weighted shaft that is inserted into the shaft to increase weight of the training aid.

* * * * *